United States Patent [19]

Dandl

[11] Patent Number: 4,641,060

[45] Date of Patent: Feb. 3, 1987

[54] METHOD AND APPARATUS USING ELECTRON CYCLOTRON HEATED PLASMA FOR VACUUM PUMPING

[75] Inventor: Raphael A. Dandl, San Marcos, Calif.

[73] Assignee: Applied Microwave Plasma Concepts, Inc., Encinitas, Calif.

[21] Appl. No.: 700,046

[22] Filed: Feb. 11, 1985

[51] Int. Cl.[4] ..... H01J 7/24; H05B 31/26

[52] U.S. Cl. ..... 315/111.71; 313/161; 313/231.31; 315/111.21; 315/111.41; 315/39; 376/123

[58] Field of Search ..... 315/111.41, 111.71, 315/111.61, 111.21, 39, 111.51; 313/161, 231.31; 376/123, 130, 161

[56] References Cited

U.S. PATENT DOCUMENTS

| | | | |
|---|---|---|---|
| 3,105,803 | 10/1963 | Weibel | 313/161 X |
| 3,113,088 | 12/1963 | Josephson | 313/161 X |
| 3,120,476 | 2/1964 | Post | 313/161 X |
| 3,160,566 | 12/1964 | Dandl et al. | 313/161 X |
| 3,257,579 | 6/1966 | Delcroix et al. | 315/111.71 X |
| 3,425,902 | 2/1969 | Consoli et al. | 313/161 |
| 3,571,734 | 3/1971 | Consoli et al. | 313/161 |
| 4,417,178 | 11/1983 | Geller | 315/111.41 |

*Primary Examiner*—Saxfield Chatmon
*Attorney, Agent, or Firm*—Robert C. Hill

[57] ABSTRACT

A method and apparatus is disclosed for producing a gas pumping plasma within an evacuated enclosure having a collimating system consisting of baffle structures and a magnetic field having a central uniform region connected to a source of neutral gas, a magnetic mirror intermediate region and a terminating divergent region. According to the method and apparatus of the present invention, the enclosure is evacuated to a selected pressure, high frequency microwave energy of a selected power and frequency is fed into the magnetic mirror intermediate region, the magnetic field is established at a strength such that an electron cyclotron frequency is made equal to the frequency of the microwave energy within the intermediate region, electrons within the magnetic mirror intermediate region being heated by the microwave energy, the heated electrons ionizing the neutral gas in the intermediate and central regions for creating and maintaining a pumping plasma. Baffle structures are provided between the central and intermediate regions and between the intermediate and terminal regions for permitting unobstructed flow of plasma along the magnetic field lines to the terminal region while restricting inward flow of neutral gas resulting from recombination in the terminal region. The plasma is preferably composed of ionized neutral gas from the central and intermediate regions and an adequate neutral gas concentration is maintained in the intermediate region by controlled supply of make-up gas.

18 Claims, 1 Drawing Figure

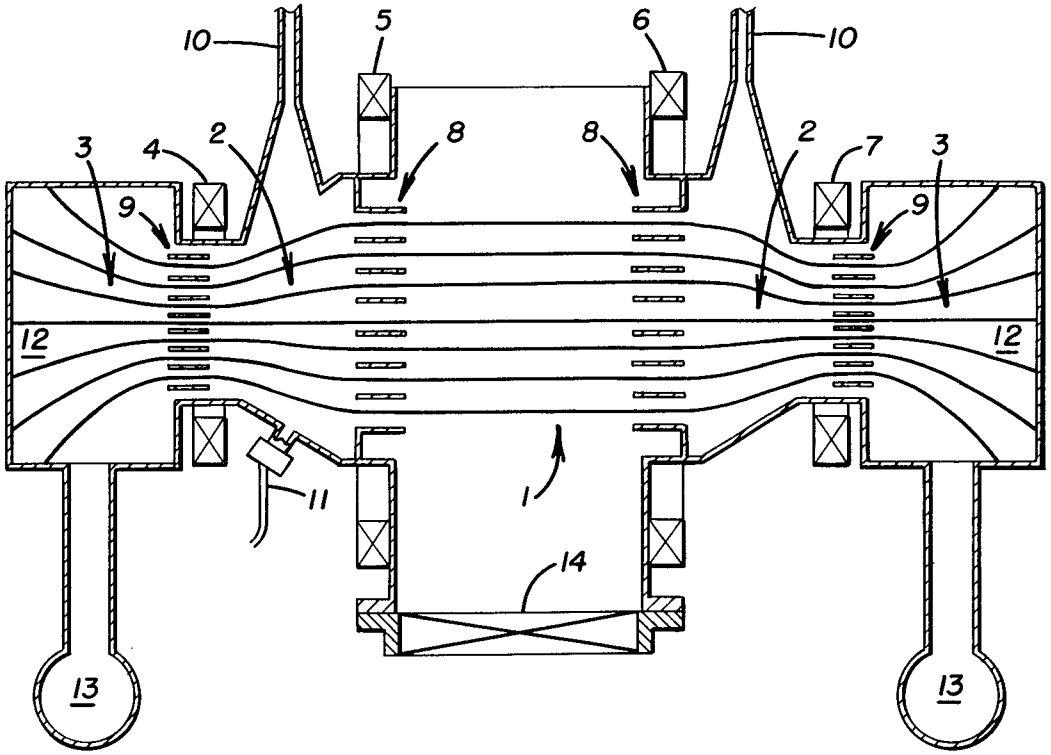
10
6
5
10
2
8
8
2
4
3
9
9
3
7
12
12
1
11
14
13
13

METHOD AND APPARATUS USING ELECTRON CYCLOTRON HEATED PLASMA FOR VACUUM PUMPING

BACKGROUND OF THE INVENTION

The present invention relates to a method and apparatus for efficient high volume pumping of neutral gas from a chamber to produce a vacuum by ionizing the neutral gas with a plasma and providing magnetic field lines for the ions to flow through the apparatus.

It is well-known in the prior art that a plasma, defined herein as a space-charge neutral ion electron gas of selected density, may be used in a variety of applications including accelerators, mass spectrometers, high temperature chemical reactors, vapor deposition devices and in controlled thermonuclear reactions such as may be carried out, for example, in tokamak reactors.

Many applications of vacuum technology require a high gas pumping rate with a minimum of contamination by foreign materials such as oil and a low pressure operating environment. The efficiency with which high vacuums can be maintained in the presence of high gas throughput is critical in applications such as large volume magnetic fusion devices and in other applications of the type summarized above. There has also been found to exist a need, particularly in magnetic fusion devices, for such a vacuum pump to function in the proximity of high temperature fusion plasma with a minimum of contamination of the fusion plasma itself.

A number of vacuum pumping devices and methods have been disclosed in the prior art generally of a type contemplated by the present invention. For example, reference is made to U.S. Pat. No. 3,160,566 issued Dec. 8, 1964 to R. A. Dandl et al for a plasma generator having certain structural similarities to that disclosed in the present invention.

In particular, the above-noted reference disclosed a method and apparatus for producing a stable, medium density, high temperature plasma in an evacuated enclosure permeated by a suitable magnetic field wherein the plasma was shielded from neutral gas particles by an energetic plasma blanket. The blanket was created by connecting a microwave generator to a reflecting cavity within the evacuated enclosure so that the electrons therein were heated at the electron cyclotron frequency of the electrons. The heated electrons were in turn caused to produce ions with both the ions and electrons moving along the magnetic field lines to produce the plasma blanket. The plasma blanket developed by the method and apparatus of the above-noted reference was intended to essentially eliminate charge-exchange losses of the plasma within the inside of the blanket while providing a background for dissociation, ionization, etc., for trapping and for providing a means for optimizing the electron temperature for stability.

The method and apparatus of the above-noted reference includes certain basic features in common with the method and apparatus of the present invention. Accordingly, the above-noted reference, U.S. Pat. No. 3,160,566, is incorporated herein as though set forth in its entirety to permit a better understanding of the present invention.

Even with prior art vacuum devices of the type disclosed by the above-noted reference, there has been found to remain a need for more effective vacuum pumping techniques for achieving efficient high volume pumping of neutral gas from a chamber to produce a vacuum by ionizing the neutral gas with a plasma and providing magnetic field lines for the ions to flow through the vacuum pumping apparatus.

SUMMARY OF THE INVENTION

Generally, it is an object of the present invention to provide a method and apparatus for vacuum pumping in order to realize one or more advantages of the type noted above.

In a preferred embodiment, the present invention provides a method and apparatus for producing a vacuum by using a plasma to ionize the gas in the region to be evacuated (Region 1) and removing the resulting ions along magnetic field lines to a higher pressure region (Region 3) where they can be recombined to form neutral atoms which are inhibited from flowing back to the evacuated region (Region 1). The ionizing plasma is preferably formed by electron cyclotron heating (at microwave frequencies) in another region (Region 2) where the magnetic field strength is such that gyrating electrons have the same gyration frequency as does the microwave electromagnetic field. The electrons resulting from ionization in Regions 1 and 2 gain sufficient energy from the microwave field to ionize neutral gas as they drift along magnetic field lines connecting Regions 1 and 2.

According to the method and apparatus of the present invention, microwave heating to maintain the plasma electron temperature, preferably at 10 to 100 electron volts (eV), is preferable to other plasma heating methods for several reasons:

(1) It can efficiently produce plasma at relatively low gas pressure, thereby reducing neutral backstreaming, which otherwise would limit the pumping process, and consequent negation of the vacuum pumping process.

(2) It can produce plasma sufficiently free of striations and other similar fluctuations that would normally cause outgassing in the region to be evacuated (Region 1).

(3) It can be rapidly controlled to provide a fast plasma response function as necessary for a wide set of operating conditions.

The method and apparatus of the present invention offer a number of advantages relative to conventional vacuum pumps. For example, the plasma vacuum pump is potentially more efficient and capable of sufficiently rapid response time to permit its use in feedback-control applications. In addition, such a vacuum pump exhibits outstanding compatibility with fusion plasma environments and can be easily scaled in size over a wide range. The power requirements for a plasma vacuum pump can be much less than conventional pumps because of the very small thermal capacity of the working medium, the medium being an electron cyclotron heated plasma, the density of which is likely to be less than $10^{12}$ electrons/cc. When operating a maximum throughput, the plasma electrons are supplied mainly by the pumped gas itself, thereby minimizing power flow to otherwise inactive elements such as oil jets or cryogenic panels. At low throughput rates, the plasma is maintained by suitably programmed electron cyclotron heating (ECH) power and auxiliary feed gas which permit the pump to be fully activated, from pump-off to full pumping speed, in times as short as a few milliseconds.

It is noted that a device constructed in accordance with the method and apparatus of the present invention is preferably not limited in size nor limited to any particular gas, or even corrosive gases may be present. Also, the device may be operated with an electron cyclotron heating system at different wave lengths and different magnetic fields, created by electromagnets or ferromagnetic structures, with the wavelength and magnetic field strength selected according to size and application requirements.

The plasma vacuum pump concept of the present invention is particularly well suited to fusion applications since proximity to high temperature fusion plasmas poses no technological problems, as is commonly the case for cryogenic pumps. Furthermore, unlike the cryogenic pumps, the plasma vacuum pump can be operated continuously with high reliability in uninterrupted, long-term service. The plasma vacuum pump can be far more rugged than turbomolecular pumps. In addition, impurity problems which might occur, for example, with diffusion pumps can be entirely avoided. Finally, by suitable changes in the magnetic configuration, the plasma vacuum pump can be scaled in size to meet the needs of large volume fusion reactors as well as more conventional commercial and research applications.

It should also be understood that in some applications using a large gas flow rate, a series of plasma pumping regions can be utilized. This permits operation at higher forepump pressures for more efficient pumping.

It is a further object of the invention to provide a method and apparatus for vacuum pumping useful in those applications requiring high speed evacuation with minimum oil contamination and an operating environment in the pressure range of about $10^{-4}$ to $10^{-7}$ Torr.

Yet another object of the invention is to provide a method and apparatus where electron cyclotron heating is employed to create a plasma in a magnetic field and to maintain desired electron temperatures.

Additional and further objects of the present invention will be apparent from the following description and claims as well as the accompanying drawing which, by way of illustration, shows a preferred embodiment of the invention and the principles thereof and what are now considered to be the best modes contemplated for applying these principles. Other embodiments of the invention employing similar or equivalent principles may be used and structural changes may be made as desired by those skilled in the art without departing from the present invention and the purview of the appended claims.

The single drawing accompanying the present application discloses a preferred embodiment of vacuum pumping apparatus constructed in accordance with the present invention and suitable for carrying out the method of the invention.

Before describing the preferred embodiment of the present invention in connection with the accompanying drawing, a theoretical analysis providing the basis for the method and operation of the present invention is set forth below.

Theoretical Analysis for Design of a High Speed Plasma Vacuum Pump

Part I: Introduction

The following analysis is set forth to evolve a preconceptual design of a high-speed plasma vacuum pump according to the present invention with unique capabilities. Novel methodology is employed whereby electron cyclotron heating creates and sustains large volumes of ionizing plasma.

Objectives of the invention were achieved by analyzing a multi-region plasma vacuum pump concept described hereinafter in Part II. This approach led to identification of critical design parameters determining the performance of the plasma vacuum pump, as discussed hereinafter in Part III, where the fundamental aspects of the concept are illustrated in an operational range appropriate to large tokamak reactors. The special advantages of the high-speed plasma vacuum pump for pumping large throughputs of helium are particularly evident in this application.

The analysis set forth below in Part III focuses attention on a number of issues critical to the successful hardware implementation of the plasma vacuum pump concept. For example, the microwave power required for satisfactory ECH has been considered only in enough detail to confirm the anticipated high efficiency, to estimate the required input power levels, and to clarify the processes that limit the operating inlet pressures.

The analysis of Part III provides a valuable procedure for estimating the size and power required to achieve a specified pumping speed in a specified range of inlet pressures. The obvious potential of this concept for pumping virtually any gas makes it abundantly clear that the concept of the present invention provides a unique and valuable addition to vacuum pump technology.

Part II: The Reference Preconceptual Configuration

In order to establish a basis for the preconceptual design of plasma vacuum pumps of various speeds, it is necessary to analyze the basic configuration illustrated schematically in the drawing. Although the configuration is described in greater detail below and in the above-noted patent incorporated herein by reference, it is briefly summarized here to permit a complete understanding of the present theoretical analysis.

Within a suitable vacuum enclosure, there is established a magnetic field having three distinct regions: Region 1, a region of nearly uniform magnetic intensity; Region 2, a magnetic-mirror field with converging lines of force; and Region 3, a region in which the magnetic field lines diverge as shown. This magnetic field is created by a set of coils 4, 5, 6 and 7.

Regions 1 and 2 and Regions 2 and 3, are separated by baffle structures 8 and 9, respectively. These baffle structures are made up of tubular elements sized to prevent the transmission of the microwave power injected into Region 2 by waveguide couplers 10 for electron cyclotron heating. ECH is efficient for creating and maintaining a pumping plasma in Regions 1 and 2 as long as the neutral gas pressure in Region 2 is in the range from $10^{-5}$ to $10^{-4}$ Torr, but satisfactory operation may be possible over a wide range of pressures from $10^{-6}$ to $10^{-3}$ Torr. The pressure in Region 2 can be maintained near the optimum operating value by controlling a flux of input gas, $Q_f$, introduced into Region 2 through a regulated gas leak 11. The waveguide coupled microwave power supplied to Region 2 also serves as an active control element. Plasma flowing into Region 3 is dispersed over a suitable volume by the diverging magnetic field lines and recombined at cooled surfaces 12 to form neutral gas at a pressure that can be effectively pumped by conventional mechanical forepumps 13. In Part III, these elements are shown to provide high-speed pumping of a throughput, $Q_{in}$, of neutral gas at inlet pressure, $P_1$, entering through a suitable gate valve 14.

Part III: Analysis Of The High-Speed Plasma Vacuum Pump

This analysis relates to a theoretical model of the plasma vacuum pump concept described in Part II using conservation equations for the neutral gas in each of the three regions identified there. Region 1 receives a volumetric throughput, $Q_{in}$, of neutral gas from the system being pumped (volumetric fluxes of gas, Q, are related to number fluxes, $\hat{Q}$ through $\hat{Q}=3.54\times10^{19}$ Q atoms $Torr^{-1}l^{-1}$). As the result of plasma processes such as ionization and recombination, the number of gas atoms in Region 1 changes at a rate designated by $\dot{N}_{P1}^{(\circ)}$. An additional (volumetric) flux of neutral gas into Region 1, $Q_1$, results from backstreaming through baffle structure 8, separating Regions 1 and 2. In steady-state, these processes must balance as shown in Equation (1):

$$dN_1^{(\circ)}/dt=\hat{Q}_{in}+\hat{Q}_1+\dot{N}_{p1}^{(\circ)}=0 \quad (1)$$

The net flux of neutral gas into Region 2, $Q_2$, is made up of flow through the two baffle structures 8 and 9 together with any make-up gas, $Q_f$, supplied by the regulated leak 11. As in Region 1, the symbol $\dot{N}_{P2}^{(\circ)}$ indicates the rate of change in the number of gas atoms in Region 2 resulting from plasma processes-volume ionization and recombination as well as recombination of some fraction, $\epsilon_{b2}$, of the plasma striking the edges of baffle structure 9. Again, in steady-state, these processes must balance as shown in Equation (2):

$$dN_2^{(\circ)}/dt=Q_2+Q_f+\dot{N}_{p2}^{(\circ)} \quad (2)$$

Following Dushman, each of the baffle structures is characterized by their gas conductance, $S_{bj}$, so that the two volumetric gas fluxes, $Q_1$ and $Q_2$, can be related to the pressures, $P_j$, in Regions 1, 2 and 3 as shown in Equations (3) and (4):

$$Q_1=2S_{b1}(p_2-p_1), \quad (3)$$

and $$Q_2=S_{b2}(p_3-p_2)-S_{b1}(p_2-p_1). \quad (4)$$

For the immediate, preliminary analysis, volume recombination relative to ionization is neglected in estimating the rate at which plasma processes alter the number of gas atoms in Regions 1 and 2, $\dot{N}_{pj}^{(\circ)}$. Thus, the number of gas atoms in Region 1 is changed by volume plasma ionization at a rate given by Equation (5):

$$\dot{N}_{p1}^{(\circ)}=-\bar{n}_{e1}\bar{n}_{o1}<\sigma v_e>_{ion,1} V_1. \quad (5)$$

Here, $\bar{n}_{e1}$ and $\bar{n}_{o1}$ are the average densities of electrons and gas atoms, respectively; $<\sigma v_e>_{ion,1}$ is the ionization rate due to electron impact ionization in Region 1; and $V_1$ is the volume of Region 1. The neutral density is conveniently expressed in terms of the gas pressure, using the same constant that relates volumetric and particle flux, as follows:

$$\bar{n}_{oj}=3.54\times10^{19}p_j \text{ atoms } Torr^{-1}l^{-1}$$

With this substitution, Equation (5) may be restated in Equation (6):

$$\dot{N}_{p1}^{(o)}=-3.54\times10^{19}\,p_1\frac{\text{atoms}}{\text{Torr}\cdot l}\,\bar{n}_{e1}<\sigma v_e>_{ion,1} V_1 \quad (6)$$

-continued $$\equiv -\hat{\gamma}_1 p_1 V_1,$$

where we have defined a new parameter, $$\hat{\gamma}_j\equiv 3.54\times10^{19}\frac{\text{atoms}}{\text{Torr}\cdot l}\,n_{ej}<\sigma v_e>_{ion,j},$$

with the corresponding quantity, $$\gamma_j\equiv n_{ej}v_e>_{ion,j}.$$

The steady-state gas conservation equation for Region 1 is therefore given in this approximation by Equation (7):

$$0=Q_{in}+2S_{b1}(p_2-p_1)-\gamma_1 p_1 V_1. \quad (7)$$

The plasma processes affecting the number of gas atoms in Region 2 are again assumed to be dominated by volume ionization while allowing for the possibility of surface recombination of some fraction, $\epsilon_{b2}$, of the outflowing plasma on the outer baffle structure 9 by including in $N_{p2}^{(\circ)}$ an additional term as set forth in Equation (8):

$$\dot{N}_{p2}^{(\circ)}=-\gamma_2 p_2 V_2+\epsilon_{b2}\hat{\gamma}_1 p_1 V_1/2. \quad (8)$$

Here, $\hat{\gamma}_1 p_1 V_1/2$ is the flux of plasma from Region 1 that passes through the outer baffle structure 9. The steady-state gas conservation equation for Region 2 is therefore given in an approximation set forth in Equation (9):

$$0=S_{b2}(p_3-p_2)-S_{b1}(p_2-p_1)+Q_f-\gamma_2 p_2 V_2+\epsilon_{b2}\gamma_1 p_1 V_1/2. \quad (9)$$

The steady-state gas conservation equation for Region 3 is assumed to be satisfied by the forepump throughput, $Q_{out}$, given by Equation (10):

$$Q_{out}=\gamma_1 p_1 V_1\left(1-\frac{\epsilon_{b2}}{2}\right)+\gamma_2 p_2 V_2-S_{b2}(p_3-p_2). \quad (10)$$

These equations can be used to select the pump size necessary to achieve a specified pumping speed over a prescribed range of inlet pressures. Equation (7) is first rearranged in the form of:

$$\gamma_1 p_1 V_1\left[1-\frac{2S_{b1}}{\gamma_1 V_1}\left(\frac{p_2}{p_1}-1\right)\right]=Q_{in}.$$

For typical ECH generated pumping plasma, electron densities and temperatures are anticipated in the neighborhood of $\bar{n}_e\sim5\times10^{11}$ $cm^{-3}$ and $\bar{T}_e\leqq100$ eV, so that (for hydrogen, say)

$$\gamma_1=0(10^4 \text{ sec}^{-1}).$$

Furthermore, compression ratios are expected such that $$p_2/p_1=0(10^2).$$

Under these circumstances, the Region 1 volume, $V_1$, and the baffle structure 8 are selected such that $$\frac{2S_{b1}}{\gamma_1 V_1} << 10^{-2},$$

where $$V_1 = \frac{1}{\gamma_1}\left(\frac{Q_{in}}{p_1}\right)_{nominal}.$$

For example, a large tokamak reactor may require a pumping speed, $Q_{in}/p_1$, in the neighborhood of $10^7$ l/sec by virtue of a throughput, $Q_{in}$, of 60 Torr·l/sec at an inlet pressure above $6\times10^{-6}$ Torr. A suitable plasma vacuum pump would require a Region 1 volume, $V_1=10^3$ l, and an inner baffle structure 8 with conductance $S_{b1}<<5\times10^4$ l/sec, say $S_{b1}\sim10^4$ l/sec.

The volume of Region 2, $V_2$, can be chosen by considering the dominant terms of Equation (9) given by $$\gamma_2 p_2 V_2 \sim S_{b2}(p_3 - p_2),$$

or $$V_2 \sim \frac{S_{b2}}{\gamma_2}\left(\frac{p_3}{p_2} - 1\right).$$

If a compression ratio, $p_3/p_2\sim10^2$ and a pumping plasma are anticipated such that $\gamma_2\sim10^4\,\mathrm{sec}^{-1}$, then for an outer baffle structure 9 similar to the inner baffle structure 8, the following relation is obtained:

$$V_2 \sim \frac{S_{b2}}{10^2}\,\mathrm{sec} \cong \frac{S_{b1}\,\mathrm{sec}}{10^2} \sim 10^2 l.$$

For this configuration, the estimated pumping speed, $Q_{in}/p_1$, varies with inlet pressure, $p_1$, as shown in FIG. 2.

The decrease in pumping speed for pressures above $10^{-4}$ Torr results from the reduction in $\gamma_1$ associated with diminished ECH operation at high pressure, as discussed in greater detail in Part IV. The ECH power can be roughly estimated from the considerations enumerated in Part IV and, for the present example, it is anticipated that less than 100 kW will suffice.

Part IV: Basic Aspects of the Baffle Concept

The baffle structures referred to above in the reference configuration are made up of arrays of tubes whose dimensions are chosen to satisfy three conditions: the gas conductance required for satifactory pumping operation at the design speed and inlet pressure; reactive blocking of microwave propagation at the ECH frequency; and inner radii larger than the perpendicular diffusion length for plasma flowing through the baffle. Basic elements are presented hereinbelow which enter into each of these constraints.

The gas conductance of each tube is assumed to be the value appropriate to large Knudsen numbers:

$$K=\lambda_o/2a_{bi}>>1,$$

where $\lambda_o$ is the mean-free-path of a neutral atom and $2a_{bi}$ is the inner diameter of each tube. Dushman gives a formula for this conductance that, when converted into cgs units, takes the form $$U = \frac{98.2\,a_{bi}^2}{L_b + 2.64\,a_{bi}}\;\frac{l}{\mathrm{cm}^2\,\mathrm{sec}},$$

where $L_b$ is the length of each baffle tube.

The baffle structures are assumed for the moment to be cylindrical and made up of some large number, N, of these tubes. The overall cross-sectional area of the baffle structure is just $\pi R_b^2$. but the cross-sectional area that is transparent to the magnetized plasma is a fraction of this:

$$(1-K_b)\pi R_b^2 = N\pi a_{bi}^2.$$

For a hexagonal close-packed array of tubes, $$1 - K_b = \frac{\pi a_{bi}^2}{2\sqrt{3}\,a_{bo}^2},$$

where $2a_{bo}$ is the outer diameter of the tubes. Assuming the $\Delta a$, wall thickness of each tube, is 5–6% of the outer radius, it results that $$K_b = 1 - \frac{\pi}{2\sqrt{3}}\left(1 - \frac{\Delta a}{a_{bo}}\right)^2 \cong 0.2.$$

These baffle structures can reactively block the propagation of ECH microwave power if the inner diameter is less than a quarter wavelength of the heating power. Thus, the following relation is required:

$$a_{bi} \leqq \lambda_\mu/8,$$

where $\lambda_\mu$ is the wavelength of the microwave radiation supplied for ECH. The wavelengths in the pumping plasma are generally somewhat greater than their free-space value, so that a conservative restriction is simply $$8a_{bi} \leqq c/f_\mu = 2\pi m_e c/eB_{res}.$$

Here, $f_\mu$ is the microwave frequency, $m_e$ and e are the rest mass and electric charge of an electron, respectively, C is the speed of light in vacuum, and $B_{res}$ is the resonant magnetic field strength, $$B_{res} = 2\pi\frac{m_e}{e}f_\mu.$$

Finally, in order to avoid excessive recombination of plasma on the interior walls of the baffle structure, it is assumed that the inner radius, $a_{bi}$, be much larger than the distance the plasma can diffuse across the magnetic lines of force during the time taken to flow through the baffle along these lines of force. An upper bound on the diffusion coefficient is given by the Bohm rate, $$D_B = \frac{1}{16}\;\frac{T_e}{eB},$$

where $T_e$ is the electron temperature. Thus, it is assumed that $$\sqrt{\frac{D_B L_b}{v_i}} = \left(\frac{1}{16}\ \frac{T_e L_b}{eBv_i}\right)^{\frac{1}{2}} < a_{bi},$$

or $$\frac{1}{16}\ \frac{T_e}{eBv_i}\ \frac{L_b}{a_{bi}} < a_{bi}.$$

If a condition is imposed for microwave cutoff in the baffle tubes, a restriction on the aspect ratio of these tubes results as follows:

$$\frac{1}{16}\ \frac{T_e}{eBv_i}\ \frac{L_b}{a_{bi}} < \frac{\pi}{4}\ \frac{m_e c}{eB_{res}}.$$

Neglecting for the present the difference between the magnetic field strength at the baffle, B, and the resonant field, $B_{res}$, results in:

$$\frac{L_b}{a_{bi}} < 4\pi \frac{m_e c v_i}{T_e}.$$

For typical design choices, this condition requires that $$L_b/a_{bi} < 13.$$

Part V: A Model Of The ECH Process

A rudimentary model of the ECH process is described below that leads to useful relations determining the density, $n_e$, and temperature, $T_e$, of the pumping plasma in terms of the microwave power absorbed in the pumping plasma, $P_\mu$, and the neutral gas density in Regions 1 and 2. The density and temperature of the pumping plasma determine, in turn, the plasma pumping speed, $\gamma = n_e < \sigma v_e >_{ionization}$. The relations derived here have been used in the model analysis of Part III, where the reduction in $\gamma$ at higher inlet pressures produced a corresponding reduction in the pump speed.

The basic assumptions of this model are that the ions of the pumping plasma flow freely along the magnetic lines of force at their thermal speed, $v_{thi}$. The much faster plasma electrons must be electrostatically confined if quasi-neutrality is to be maintained by ambipolar plasma flow into Region 3. Here, a more conservative position is taken that the flow may not be enhanced by that amount and use the slowest reasonable flow velocity, $v_{thi}$:

$$v_{thi} = \sqrt{\frac{2T_i}{M_i}} << c_s = \sqrt{\frac{5}{2}\ \frac{T_e}{M_i}}.$$

In steady-state, the outflow of plasma must be balanced by volume ionization. The ionization rate, $<\sigma v_e>_{ion}$, depends on the gas being pumped and on the electron temperature. In the numerical cases to be cited here, the rate for electron ionization of atomic hydrogen has been taken and, since it is anticipated that electron temperatures are present in the range of 10–40 eV, a crude linear estimate of $<\sigma v_e>_{ion}$ is used as follows:

$$<\sigma v_e>_{ion} \cong 6 \times 10^{-10}\, T_e \frac{\text{cm}^3}{eV\ \text{sec}}.$$

The actual ionization rate for typical gases is greater than the approximate model rate over the range of electron temperatures relevant to the plasma vacuum pump concept, so that the present model generally underestimates the actual pump performance.

Particle balance than requires that $$2A_{b2} \int d^3v\, v_{11} f_i = \int d^3r\, n_e n_o <\sigma v_e>,$$

Regions 1 and 2 where $A_{b2}$ is the transparent area of the outer baffle structure, $$A_{b2} = (1 - K_b)\pi R_{b2}^2,$$

and $f_i$ is the ion distribution function, here assumed to be Maxwellian, $$f_i = n_i(\pi v_{thi}^2)^{-3/2} \exp\left(-\frac{v^2}{v_{thi}^2}\right).$$

Thus, $$2A_{b2} \frac{n_i v_{thi}}{\sqrt{\pi}} = n_{e1} n_{o1} < \sigma v >_1 V_1 + 2n_{e2} n_{02} <\sigma v >_2 V_2.$$

Assuming the pumping plasma to be uniform throughout Regions 1 and 2 results in:

$$< \sigma v > \cong \frac{2A_{b2}\, v_{thi}}{\sqrt{\pi}}\ \frac{n_{e1}}{n_i}\, n_{o1} V_1 + \frac{2n_{e2}}{n_i}\, n_{o2} V_2^{-1}$$

$$\cong \frac{2A_{b2}\, v_{thi}}{\sqrt{\pi}} (n_{o1} V_1 + 2n_{02} V_2)^{-1}.$$

Over the temperature range of interest, 10 eV$\lesssim T_e \lesssim$40 eV, it is estimated that $<\sigma v>$, as discussed above, in order to arrive at the relation for $T_e$:

$$T_e \cong \frac{1}{6 \times 10^{-10}}\ \frac{\text{eV} \cdot \text{sec}}{\text{cm}^3}\ \frac{2A_{b2}\, v_{thi}}{\sqrt{\pi}} (n_{o1} V_1 + 2n_{e2} V_2)^{-1}.$$

Steady-state energy conservation for the pumping-plasma electrons takes the form $$\frac{5}{2} \times 2A_{b2} \times T_e \int d^3v\, v_{11} f_i + Q_{ei}(V_1 + 2V_2) + \frac{3}{2}(n_{01} V_1 + 2n_{02} V_2) n_e E_{ion} < \sigma v_e >_{ion} = P_\mu.$$

Here, $Q_{ei}$ represents the power transferred to the pumping-plasma ions through Coulomb collisions at the rate $\nu_{ei}$:

$$Q_{ei} = 3\nu_{ei} n_e \frac{m_e}{M_i}(T_e - T_i).$$

For the present, this process is neglected.

The energy that must be provided to yield an ion-electron pair is denoted $E_{ion}$. Note that it is larger than the ionization potential because of the energy loss due to excitation processes. Thus, a value of $E_{ion} \cong 20$ eV for hydrogen is assumed.

Once again, setting $$<\sigma v_e>_{ioniz} = 6 \times 10^{-10}\, T_e \frac{\text{cm}^3}{eV \cdot \text{sec}}$$

and substituting for $T_e$ from the previous result, an expression is obtained for the pumping plasma electron density as follows:

$$n_e = \frac{\sqrt{\pi}\, P_\mu}{2A_{b2}v_{thi}\left(\frac{5}{2}T_e + \frac{3}{2}E_{ion}\right)}.$$

DESCRIPTION OF THE PREFERRED EMBODIMENT

The basic configuration for a vacuum pumping device constructed in accordance with the method and apparatus of the present invention is schematically illustrated in the single drawing. As noted above, numerous features of the configuration in the drawing conform with features of a vacuum pumping device disclosed by a reference patent noted above and incorporated herein.

In addition to the preceding background information as summarized above, the device illustrated in the drawings provides a suitable vacuum enclosure in which is established a magnetic field having three distinct regions described as follows. A first region of nearly uniform magnetic intensity is identified as Region 1. A magnetic-mirror field with converging lines of force is identified as Region 2 while a region in which the magnetic field lines diverge as shown in the drawing is identified as Region 3.

The magnetic field including the above-noted regions is created by a set of four magnetic mirror coils indicated, respectively, at 4, 5, 6 and 7.

Regions 1 and 2 are separated by a baffle structure 8 while Regions 2 and 3 are separated by a separate baffle structure 9. Both of the baffle structures 8 and 9 are made up of tubular elements sized to prevent the transmission of microwave power injected into Region 2 by one or more waveguide couplers indicated at 10 for achieving electron cyclotron heating within the device.

Electron cyclotron heating is particularly efficient for creating and maintaining a pumping plasma in Regions 1 and 2 as long as the neutral gas pressure in Region 2 is in the range from $10^{-5}$ to $10^{-4}$ Torr. However, satisfactory operation is possible over a wider range of pressures from $10^{-6}$ to $10^{-3}$ Torr. The pressure in Region 2 is preferably maintained near the optimum operating value by controlling a flux of input gas, $Q_f$, introduced into Region 2 through a regulated gas leak indicated at 11.

The waveguide-coupled microwave power supplied to Region 2 also serves as an active control element. Plasma flowing into Region 3 is dispersed over a suitable volume by the diverging magnetic field lines and recombined at cooled surfaces indicated at 12 to form neutral gas at a pressure that can be effectively pumped by mechanical forepumps indicated at 13. These elements can be shown theoretically, as described above, to provide highspeed pumping of a throughput, $Q_{in}$, of neutral gas at inlet pressure, $p_1$, entering through a suitable gate valve indicated at 14.

The preceding description is believed to permit a complete understanding of the vacuum pumping device of the present invention, particularly when taken in combination with the disclosure of the above-noted reference.

The device described above in connection with the single drawing is also suitable for carrying out the method of the present invention which is believed obvious from the preceding description and theoretical analysis. However, the method of operation is briefly described again below in order to assure a complete understanding of the invention.

Having reference to the enclosed drawing and the preceding description, a method according to the present invention is contemplated for producing a gas pumping plasma within an evacuated enclosure such as the device illustrated in the drawing. The enclosure includes a collimating system consisting of baffle structures 8 and 9, a magnetic field having a central uniform region connected to a source of neutral gas to be pumped, a magnetic mirror intermediate region and a terminating divergent region as described above. The method of the invention contemplates evacuating the enclosure to a selected pressure and establishing the magnetic field at a selected strength. Electrons are then heated within the magnetic mirror intermediate region to a selected level whereupon the heated electrons ionize neutral gas in the intermediate and central regions in order to create and maintain a pumping plasma in the intermediate and central regions. Baffle structures as indicated at 8 and 9 are provided respectively between the central and intermediate regions and between the intermediate and terminal regions for permitting unobstructed flow of plasma along the magnetic field lines to the terminal region while restricting the inward flow of neutral gas resulting from recombination in the terminal region, the plasma being composed of ionized neutral gas from the central and intermediate regions. An adequate neutral gas concentration is maintained in the intermediate region by means of a controlled supply of make-up gas.

Preferably, the pumping plasma is established by feeding high frequency microwave energy of a selected power and frequency into the magnetic mirror intermediate region. The high frequency microwave energy is preferably selected in accordance with the theoretical discussion set forth above such that the electronic cyclotron frequency is made equal to the frequency of the microwave energy within the intermediate region in order to better carry out the method of the present invention.

While the preferred embodiment of the present invention, in the form of both a method and apparatus, has been illustrated and described above, it is to be understood that both the method and apparatus of the invention are capable of further variation and modification in addition to the preceding description. Therefore, the method and apparatus of the invention are not to be limited to the precise details set forth above. Rather, the method and apparatus of the invention are to be taken as including variations and modifications falling within the purview of the following claims.

What is claimed is:

1. A method of producing a gas pumping plasma within an evacuated enclosure having a collimating system consisting of baffle structures and a magnetic field having a central uniform region connected to a source of neutral gas to be pumped, a magnetic mirror intermediate region and a terminating divergent region, comprising the steps of evacuating the enclosure to a selected pressure, feeding high frequency microwave energy of a selected power and frequency into the magnetic mirror intermediate region, establishing the magnetic field at a strength such that an electron cyclotron frequency is made equal to the frequency of the microwave energy within the intermediate region, the electrons within the magnetic mirror intermediate region being heated by the microwave energy up to 100 electron volts, the heated electrons ionizing the neutral gas in the intermediate and central regions, and thereby creating and maintaining a pumping plasma in the intermediate and central regions, providing baffle structures between the central and intermediate regions and between the intermediate and terminal regions, thereby permitting unobstructed flow of plasma along the magnetic field lines to the terminal region while restricting the inward flow of neutral gas resulting from recombination in the terminal region, the plasma being composed of ionized neutral gas from the central and intermediate regions, and maintaining an adequate neutral gas concentration in the intermediate region by controlled supply of make-up gas.

2. The method of claim 1 wherein the baffle structures confine the microwave energy to the intermediate region.

3. The method of claim 2 wherein the baffle structures are sized to reactively prevent microwave transmission.

4. The method of claim 1 wherein the selected pressure is in the range of from about $10^{-6}$ Torr to $10^{-3}$ Torr.

5. The method of claim 1 wherein a series of plasma pumping regions is utilized to create and maintain a gas pressure difference in the presence of a large gas flow rate.

6. In a plasma vacuum pump assembly for producing a gas pumping plasma within an evacuated enclosure including means for developing a magnetic field having a central uniform region connected to a source of neutral gas to be pumped, magnetic mirror means forming a magnetic mirror intermediate region and a terminating divergent region, and a collimating system consisting of baffle structures, the combination comprising means for evacuating the enclosure to a selected pressure, means for feeding high frequency microwave energy of a selected power and frequency into the magnetic mirror intermediate region, means for establishing the magnetic field at a strength such that an electron cyclotron frequency is made equal to the frequency of the microwave energy within the intermediate region, the electrons within the magnetic mirror intermediate region being heated by the microwave energy up to 100 electron volts, the heated electrons ionizing the neutral gas in the intermediate and central regions, and thereby creating and maintaining a pumping plasma in the intermediate and central regions, baffle structures arranged respectively between the central and intermediate regions and between the intermediate and terminal regions for permitting unobstructed flow of plasma along the magnetic field lines to the terminal region while restricting the inward flow of neutral gas resulting from recombination in the terminal region, the plasma being composed of ionized neutral gas from the central and intermediate regions, and means for controlling a supply of make-up gas in the intermediate region for maintaining an adequate neutral gas concentration therein.

7. The plasma vacuum pump assembly of claim 6 wherein the baffle structures are adapted for confining the microwave energy to the intermediate region.

8. The plasma vacuum pump assembly claim 7 wherein the baffle structures are sized to reactively prevent microwave transmission.

9. The plasma vacuum pump assembly of claim 6 wherein the evacuating means is adapted for maintaining the selected pressure in the range of from about $10^{-6}$ Torr to $10^{-3}$ Torr.

10. The plasma vacuum pump assembly of claim 6 wherein a series of plasma pumping regions is utilized to create and maintain a gas pressure difference in the presence of a large gas flow rate.

11. A method of producing a gas pumping plasma within an evacuated enclosure having a collimating system consisting of baffle structures and a magnetic field having a central uniform region connected to a source of neutral gas to be pumped, a magnetic mirror intermediate region and a terminating divergent region, comprising the steps of evacuating the enclosure to a selected pressure, establishing the magnetic field at a selected strength, heating electrons within the magnetic mirror intermediate region to a selected level up to 100 electron volts whereupon the heated electrons ionize the neutral gas in the intermediate and central regions in order to create and maintain a pumping plasma in the intermediate and central regions, providing baffle structures respectively between the central and intermediate regions and between the intermediate and terminal regions for permitting unobstructed flow of plasma along the magnetic field lines to the terminal region while restricting the inward flow of neutral gas resulting from recombination in the terminal region, the plasma being composed of ionized neutral gas from the central and intermediate regions, and maintaining an adequate neutral gas concentration in the intermediate region by means of a controlled supply make-up gas.

12. The method of claim 11 wherein the baffle structures confine the microwave energy to the intermediate region.

13. The method of claim 12 wherein the baffle structures are sized to reactively prevent microwave transmission.

14. The method of claim 11 wherein the selected pressure is in the range of from $10^{-6}$ Torr to $10^{-3}$ Torr.

15. The method of claim 11 wherein a series of plasma pumping regions is utilized to create and maintain a gas pressure difference in the presence of a large gas flow rate.

16. The method of claim 1 wherein electron temperatures are present in the range of from 10 to 40 electron volts.

17. The plasma pump assembly of claim 6 wherein electron temperatures are present in the range of from 10 to 40 electron volts.

18. The method of claim 11 wherein electron temperatures are present in the range of from 10 to 40 electron volts.

* * * * *